US005222357A

United States Patent [19]

Eddy et al.

[11] Patent Number: 5,222,357

[45] Date of Patent: Jun. 29, 1993

[54] GAS TURBINE DUAL FUEL NOZZLE

[75] Inventors: Jeffrey C. Eddy, Oviedo; J. Wayne Myers, Longwood, both of Fla.

[73] Assignee: Westinghouse Electric Corp., Pittsburgh, Pa.

[21] Appl. No.: 823,397

[22] Filed: Jan. 21, 1992

[51] Int. Cl.[5] ..... F02C 1/00

[52] U.S. Cl. ..... 60/39.32; 60/746

[58] Field of Search ..... 60/39.32, 740, 742, 60/746

[56] References Cited

U.S. PATENT DOCUMENTS

| | | | |
|---|---|---|---|
| 2,968,925 | 1/1961 | Blevans et al. | 60/740 |
| 3,777,983 | 12/1973 | Hibbins | 60/742 |
| 4,154,056 | 5/1979 | Emory | 60/39.32 |
| 4,337,618 | 7/1982 | Hughes et al. | 60/742 |
| 4,566,268 | 1/1986 | Hoffeins et al. | 60/742 |
| 4,977,740 | 12/1990 | Madden et al. | 60/742 |

*Primary Examiner*—Richard A. Bertsch
*Assistant Examiner*—Howard R. Richman
*Attorney, Agent, or Firm*—K. Bach

[57] ABSTRACT

In a gas turbine dual fuel nozzle including a main nozzle body with a support flange having a liquid fuel and atomizing air nozzle structure centrally extending therethrough with a fuel and atomizing air discharge structure arranged at its free end and a fuel gas supply structure arranged around the free end of the fuel and atomizing air discharge structure wherein the fuel gas supply structure has a front face extending inwardly adjacent the fuel and atomizing air discharge structure and having a central opening permitting the discharge of liquid fuel and atomizing air therethrough, the front face has bores extending therethrough in radial symmetry in a circular array and radial slots formed therein between said bores and the central opening so as to eliminate hoop stresses in the front face around its central opening.

5 Claims, 2 Drawing Sheets

GAS TURBINE DUAL FUEL NOZZLE

BACKGROUND OF THE INVENTION

The present invention relates to a dual fuel nozzle for gas turbines which permits operation of a gas turbine with liquid and gaseous fuels. Such a dual fuel nozzle is shown for example in Westinghouse Brochure PDL 1510-15B.

Fuel injection nozzles are mounted on the gas turbine combustors and consequently are exposed to high temperature, particularly high radiant heat, during turbine operation. Since their fuel and air supply orifices are arranged in a concentric pattern they also have a relatively large face area exposed to the high heat radiation from the combustion chambers which has generated high face plate temperatures and hoop stresses resulting in cracks developing around the center fuel discharge opening of the nozzle.

It is the principal object of the present invention to provide a dual fuel nozzle for gas turbines which is not subject to cracks forming in its face that is exposed to high heat during operation of the gas turbine.

SUMMARY OF THE INVENTION

In a gas turbine dual fuel nozzle which includes a main support flange having a liquid fuel and atomizing air nozzle structure extending centrally therethrough with a fuel and atomizing air discharge structure arranged at its free end and a fuel gas supply structure arranged around the free end of the fuel and atomizing air discharge structure, the fuel gas supply structure has a front face extending inwardly adjacent the fuel and atomizing air discharge structure provided with a central opening permitting the discharge of liquid fuel and atomizing air therethrough which front face has bores extending therethrough in radial symmetry and radial slots are formed in the front face so as to extend between the bores and the central opening.

Such an arrangement greatly reduces any hoop stresses in the front face around the central opening thereof, thereby eliminating crack formation in the front face of the fuel gas supply structure.

DESCRIPTION OF THE PREFERRED EMBODIMENT

Figure 1:
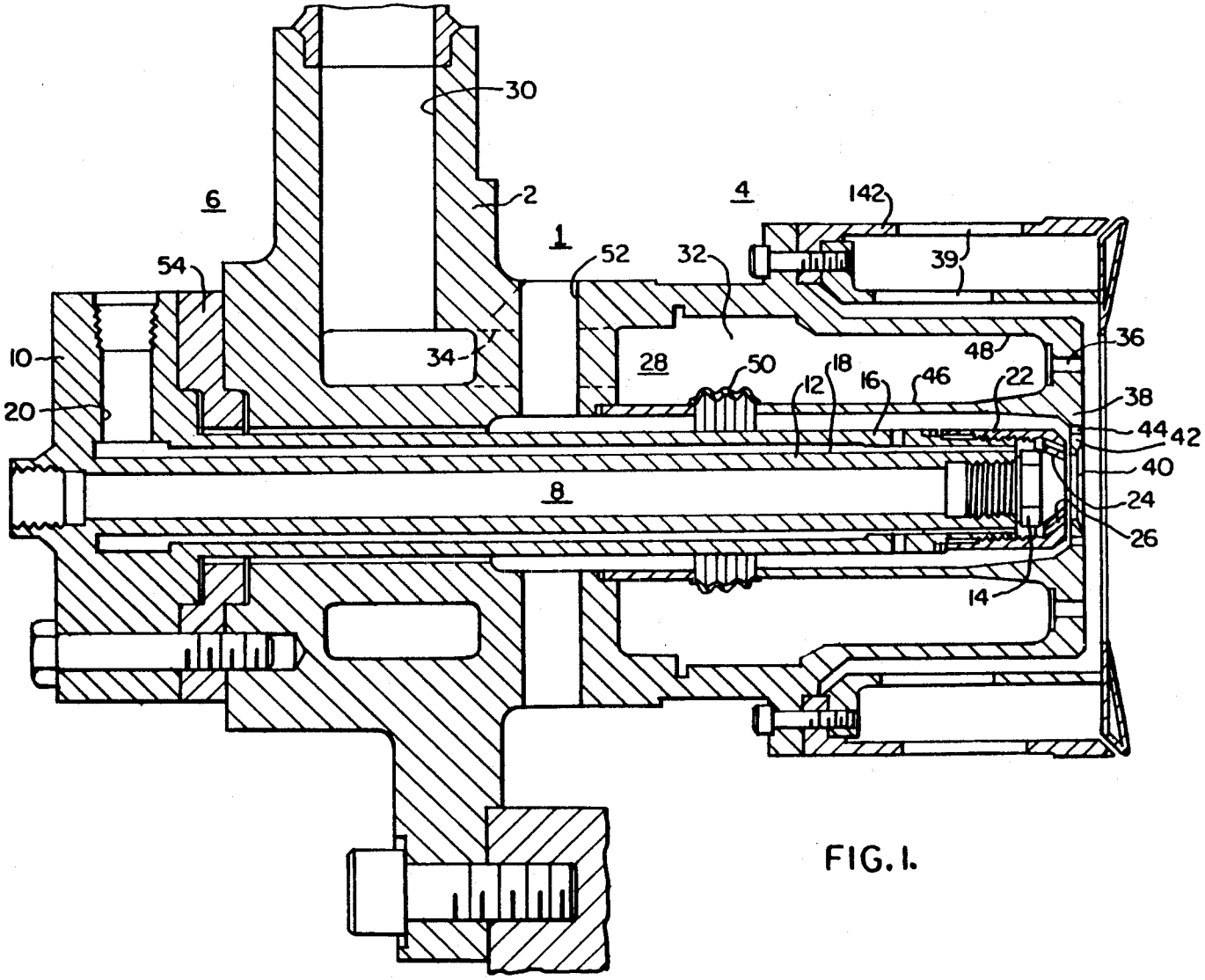
FIG. 1 is a cross-sectional view of a dual fuel nozzle incorporating the invention.

As shown in FIG. 1, a dual fuel nozzle comprises a main nozzle body 1 including a flange portion 2 adapted to be mounted on a gas turbine combustor. The nozzle body 1 has a delivery structure 4 extending from the flange portion 2 at one side thereof and a fuel and air supply structure 6 disposed at the other side. Centrally supported within, and extending through, the flange portion 2 is a liquid fuel and atomizing air nozzle structure 8 which includes a nozzle flange 10 mounted onto the flange portion 2 with a fuel nozzle tube 12 extending therefrom centrally through the nozzle body 1 and carrying at its end a liquid fuel discharge nozzle 14. An atomizing air supply pipe 16 extends around the fuel nozzle tube 12 in spaced relationship therefrom so as to form an atomizing air supply passage 18 in communication with an air supply passage 20 in the nozzle flange portion 10. The air supply pipe 16 is provided at its end with an air discharge cap 22 having a conical support opening 24 in which the conical end of the fuel discharge nozzle 14 is seated. Around the conical support opening 24 the air discharge cap 22 has atomizing air discharge passages 26 directing the atomizing air toward the liquid fuel sprayed from the fuel nozzle 14.

Figure 2:
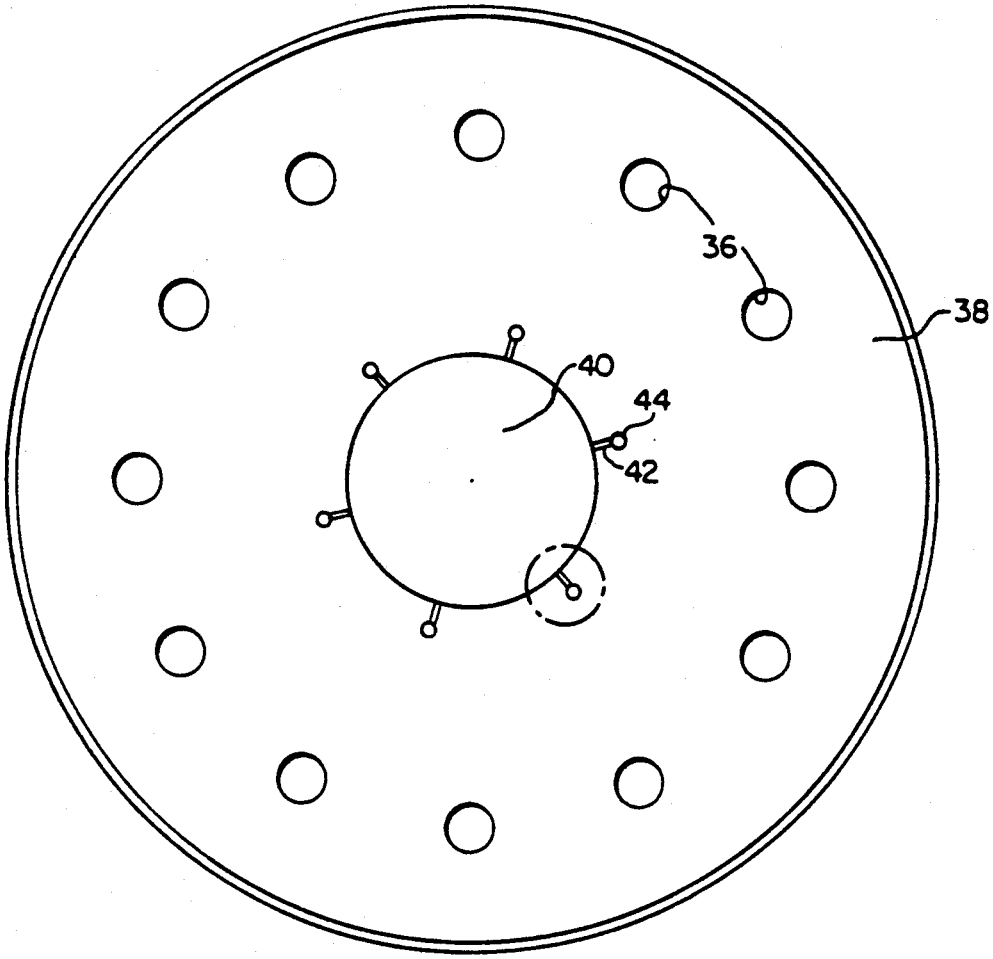
FIG. 2 is an axial front view of the nozzle face plate.
Figure 3:
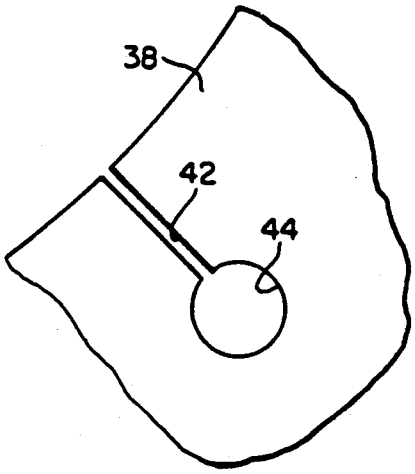
FIG. 3 is an enlarged view of the section circled in FIG. 2.

For supplying gaseous fuel to the combustor the nozzle body 1 includes an annular gas fuel supply structure 28 which extends around the liquid fuel and air nozzle structure 8. The flange portion 2 includes a gas supply passage 30 which is in communication with the annular passage 32 in the fuel gas supply structure 28 by passageways 34. At its free end, the gas fuel supply structure 28 has gas discharge orifices 36 arranged in a circular pattern around the fuel nozzle 14 as shown more clearly in FIG. 2. The gas fuel supply structure 28 extends somewhat beyond the fuel nozzle 14 and has an inwardly projecting face portion 38 with a central opening 40 for the passage of the liquid fuel and atomizing air from the liquid fuel and atomizing air nozzle structure 8.

Around its central opening 40, the fuel nozzle face portion 38 is provided with radial stress relief slots 42 terminating in bores 44. There are preferably 6 stress relief slots 42 arranged in angular symmetry around the central opening 40. The slots are preferably about 0.008 inches wide and the bores have a diameter of about 0.062" and are arranged on a circle with a 1.423" radius.

Around the fuel nozzle end the fuel discharge structure 4 carries a nozzle gap ring member 142 with a swirl plate 44 mounted thereon in such a way that there is a gap of about 0.150" between the swirl plate 44 and the face 38 of the gas fuel supply structure 28.

In order to accommodate differential expansion between the inner and outer walls 46 and 48 of the gas fuel supply structure 28 the inner wall 46 includes a bellows 50 as shown in FIG. 1. The nozzle gap ring member 142 has air holes 39 formed therein for admitting cooling air to the outer wall 48 of the annular passage 32. Cooling air is admitted to the space between the inner wall 46 of the annular passage 32 and the air supply pipe 16 via the radial passages 52 extending through the fuel supply structure 28. Also, as shown in FIG. 1, preferably a spacer 54 is arranged between the flange portion 2 and the nozzle flange 10 which spacer is machined to the appropriate dimensions to properly fit the liquid fuel supply structure 4 into the main nozzle body 1.

What is claimed is:

1. A gas turbine dual fuel nozzle including a main nozzle body with a support flange for mounting the nozzle to a fuel combustor, said support flange having a central opening with a liquid fuel and atomizing air nozzle structure extending therethrough and having a liquid fuel discharge nozzle surrounded by atomizing air discharge passages formed at its free end, and a fuel gas supply structure arranged circularly around the free end of said liquid fuel and atomizing air nozzle structure and having an inwardly extending front face structure provided with a central opening permitting the discharge of liquid fuel and atomizing air therethrough, said front face structure having bores extending therethrough in radial symmetry in a circular array at a predetermined distance from the axis of said central opening and radial slots formed between said bores and said central opening so as to eliminate hoop stresses in said front face structure adjacent its central opening.

2. A gas turbine nozzle according to claim 1, wherein six bores are arranged in said front face structure around the central opening thereof.

3. A gas turbine nozzle according to claim 1, wherein said bores are arranged on a 1.423" radius circle.

4. A gas turbine nozzle according to claim 1, wherein said bores have a diameter of about 0.062".

5. A gas turbine nozzle according to claim 1, wherein said slats are about 0.008" wide.

* * * * *